United States Patent [19]

Gagnon et al.

[11] 4,324,386

[45] Apr. 13, 1982

[54] BATTENS SYSTEM FOR RAISING AND LOWERING SCENERIES OR SIMILAR LOADS ON A STAGE

[76] Inventors: Pierre Gagnon, 5637 Wilderton St., Montreal, Quebec, Canada, H3T 1S1; Pierre LaForest, 1945 Bruxelles St., Montreal, Quebec, Canada, H1L 5Z5

[21] Appl. No.: 151,280

[22] Filed: May 19, 1980

[30] Foreign Application Priority Data

Mar. 29, 1980 [GB] United Kingdom ..... 10699/80

[51] Int. Cl.[3] ..... A63J 1/02; B66D 1/39; B66D 1/48

[52] U.S. Cl. ..... 254/288; 254/331; 272/22

[58] Field of Search ..... 254/288, 331, 283–286; 272/22; 160/331, 344, 193; 242/158 R, 158.2

[56] References Cited

U.S. PATENT DOCUMENTS

| | | | |
|---|---|---|---|
| 2,008,444 | 7/1935 | Goodsman | 242/158.2 X |
| 2,453,424 | 11/1948 | Foster | 242/158 R X |
| 3,791,627 | 2/1974 | Stone et al. | 254/331 |
| 3,804,370 | 4/1974 | Woodard | 254/365 X |
| 4,199,133 | 4/1980 | Gagnon et al. | 272/22 |

*Primary Examiner*—John M. Jillions

[57] ABSTRACT

A battens system for raising and lowering sceneries or similar loads on a stage is disclosed. The system comprises a series of support members adapted to be secured to the joists of a ceiling, an elongated winch drum made up of several sections interconnected by universal joints and supported in horizontal position by said support members, each winch drum section being provided over part of its length with a helical groove on which a cable for supporting the load is wound. Each support member carries bearing wheels engaging the helical grooves for rotatably supporting the winch drum and for causing its axial displacement at each turn by a distance equal to the pitch of the cable wound or unwound from the winch drum, such that the load will not be laterally shifted when being raised or lowered. The shaft of a reversible hydraulic motor is secured to an end of the winch drum, whereby the hydraulic motor moves with the winch drum in its axial movement. The housing of the hydraulic motor is provided with a torque arm engaging a stationary guide extending parallel to the winch drum to prevent rotation of the motor housing. The hydraulic motor is controlled by a three-position spool valve, the position of which is controlled by a reversible electric stepping motor. Movement differential between the stepping motor and the winch drum produces progressive closing and opening of the valve which results in smooth acceleration and deceleration of the load during raising or lowering, and an accurate positioning of the load. A brake is preferably provided to stop the winch drum when the hydraulic motor is not supplied with fluid under pressure.

16 Claims, 18 Drawing Figures

BATTENS SYSTEM FOR RAISING AND LOWERING SCENERIES OR SIMILAR LOADS ON A STAGE

FIELD OF THE INVENTION

This invention relates to a battens system for raising and lowering sceneries or similar loads on a stage.

BACKGROUND OF THE INVENTION

Up to now, it has been a general practice to raise and lower sceneries by means of cables passed through pulleys secured to roof joists on the stage. The cables are generally passed through further pulleys down to a control station where an operator is located. In a complex play, it is common to have up to fifty battens which have to be operated at some time during the play. This often requires the attendance of several operators, which increases the cost of labor and also takes considerable space along one wall of the stage. Moreover, due to the several counterweights and because the pulleys exert horizontal stresses on the roof joists, the same often require strengthening.

OBJECTS OF INVENTION

It is therefore the object of the present invention to provide a system which can be easily operated by a single operator at a control desk, which can be easily automated, and the installation of which does not normally require strengthening of the roof-supporting joists above the stage.

It is another object of the invention to provide a battens system in which the several winch drums, including their driving motor, are horizontally disposed close together side by side for direct cable connection with the sceneries, and no floor space is needed on the stage.

Yet another object of the invention is to provide winch drums which are easily installed and are suited for various stage widths, due to the fact that each winch drum is composed of a plurality of modular sections interconnected by universal joints.

Another object of the invention is to provide a battens system in which each winch drum is arranged for rotation for direct winding and unwinding of the load-supporting cables, while the winch drum moves axially at each turn a distance equal to the pitch of the cable wound or unwound from the winch drum, so as to prevent lateral shifting of the load.

Another object of the present invention is to provide a battens system of the character described, in which the reversible hydraulic motor driving the winch drum has its shaft directly secured to one end of the winch drum, while the motor housing has a torque arm engageable with a track means extending parallel to the winch drum, the arm preventing rotation of the motor housing.

Another object of the invention is to provide a battens system of the character described, including a slave mechanism for progressive starting and stopping of the drive motor, so as to smoothly accelerate and decelerate the load and for exact positioning of the load.

SUMMARY OF INVENTION

The battens system of the invention comprises a horizontally-disposed elongated winch drum, preferably made of a driving section and at least one driven section interconnected in end-to-end relation by means of a universal joint. Two spaced supports and bearing assemblies support the driving section and one support and bearing assembly support each driven section. A cable is wound on each section for supporting a load. The bearing assemblies engage the outer surface of the winch drum and cause longitudinal movement of the winch drum at each rotational turn of the winch drum by a distance equal to the pitch of the cable wound on, or unwound from, the winch drum. A motor drives the winch drum in rotation in two directions. Preferably the output shaft of said motor is directly connected to one end of the driving section, while a torque arm prevents the motor housing from rotating, but allows longitudinal movement of the same with the winch drum. Means are provided to control the operation of the driving motor including a controlling motor and a feedback mechanism responsive to the movement of the winch drum for progressive acceleration and deceleration of the winch drum and accurate positioning of the load. Preferably, the driving motor is a hydraulic motor fed with hydraulic fluid by a flexible hose and a braking system responsive to the hydraulic fluid pressure exerted within said hose serves to brake the winch drum against rotation whenever there is an absence of hydraulic pressure within the hose. The cables are wound on the winch drum sections in a direction to issue from these sections close to the supports to avoid torsional stress on the supports.

BRIEF DESCRIPTION OF DRAWINGS

The invention will now be disclosed by way of example with reference to the accompanying drawings, in which.

In the drawings, like reference characters indicate like elements throughout.

DETAILED DESCRIPTION OF INVENTION

The battens system of the invention comprises an elongated winch drum 10, upon which is wound one or more cables 12 supporting a scenery 14, either directly or through a pulley 16. The winch drum 10 is made of a driving tubular section 10' and of a plurality of driven tubular sections 10'' (see FIG. 7) joined together by means of universal joints for easy installation, as will become more apparent hereinafter.

Figure 4:
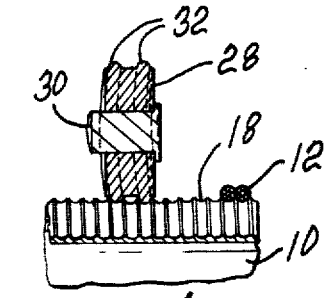
FIG. 4 is a cross-section taken along line 4—4 of FIG. 3.
Figure 10:
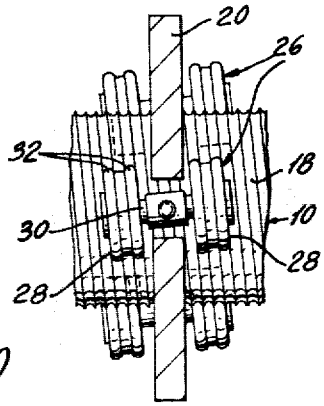
FIG. 10 is a section taken along line 10—10 of FIG. 2.

Each cable 12 is secured at one end to the winch drum 10 by means, for instance, of a collar 13 in which the cable 12 is inserted and which is rotatable about the winch drum, and can be secured in adjusted position by means of a setscrew 13*a*. Each cable 12 is wound in a continuous helical groove 18 located on the outside periphery of the drum, as shown more clearly in FIGS. 2 and 4. The pitch of the helical groove 18 thus determines the pitch of the cable being wound or unwound from the drum. Flattening of cable 12 by the load is prevented, because it is supported in groove 18 over an appreciable portion of its periphery. The winch drum 10 is rotatable in bearing assemblies, each including a vertical support plate 20 having an aperture 21 through which the drum freely extends. The support plate 20 is secured by screws 22 to a roof joist, or beam 24, near the ceiling of the stage and three sets of roller bearings 26 are mounted on plate 20 around the winch drum 10 and spaced at about 120°. Each set of roller bearings includes two rollers 28 (see FIG. 10) mounted on a shaft 30, one on each side of plate 20, with the shaft 30 inclined with respect to the plate, so as to be perpendicular to the groove 18 in accordance with its pitch. Each roller has a pair of peripheral ribs 32 engaging spaced portions of the helical groove 18 of the winch drum 10, so as to positively cause longitudinal movement of the winch drum 10 at each turn of the winch drum by a distance exactly equal to the pitch of the cable wound on the drum 10. More than three sets of roller bearings 26 could be obviously used.

The winch drum is rotated in both directions by means of a reversible hydraulic motor 34 having its output shaft 34*a* (see FIG. 2) secured to the end of the driving section 10' of the winch drum. Thus, the entire motor, including the motor housing 34*b*, moves longitudinally with the drum. The motor housing 34*b* is mounted on a plate 36 and rotation of the plate and of the motor housing, due to the counter torque exerted by the motor, is prevented by means of a radial arm 38, which is secured to the plate 36, or integral therewith, and is provided with a guide follower 40 (see FIGS. 2 and 5) engaging a guide 42 extending parallel to winch drum 10 and secured to the adjacent roof joist 24 by means of screws 44.

Preferably, a braking mechanism is provided for preventing rotation of the drum 10 under the weight of the scenery 14, or similar loads attached to the cables 12 wound on the drum 10 when the pump (not shown) supplying fluid under pressure to motor 34 is not working. Such braking mechanism may include a disc 46 secured to, or integral with, the drum 10 and brake shoes 48 mounted on plate 36. The brake shoes are applied on the disc by spring means, not shown. An electro magnet 50 serves to release the brake against the action of said spring means.

Figure 11:
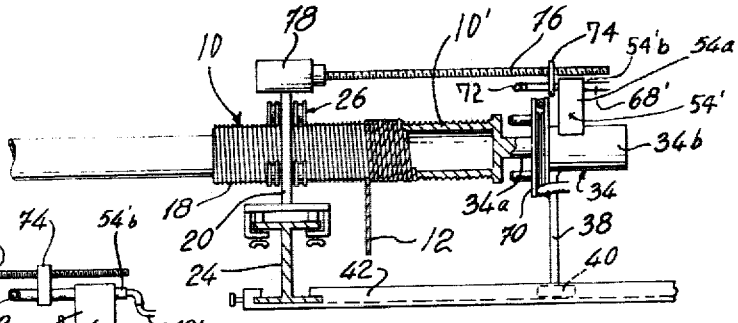
FIG. 11 is a side view, partly in longitudinal section, of a battens system showing a modified slave mechanism.

Another type of braking means operated by the hydraulic liquid feeding tube of the motor 34 can be provided, as schematically shown at 70 in FIG. 11 and as more clearly described in a co-pending U.S. patent application entitled: "BRAKE", by the same inventors, filed under Ser. No. 06/074,110 dated Sept. 10, 1979, now U.S. Pat. No. 4,271,934.

Figure 5:
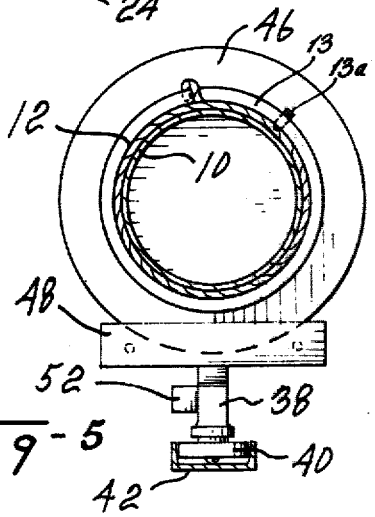
FIG. 5 is a cross-section taken along line 5—5 of FIG. 2.

A strain gauge 52 may be provided on the arm 38, as shown in FIG. 5, for stopping motor 34 when the torque applied to the motor 34 is above or below a predetermined range.

Figure 7:
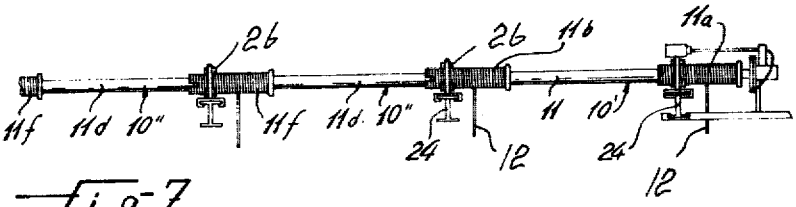
FIG. 7 is a side view of the battens system in accordance with the invention.
Figure 8:
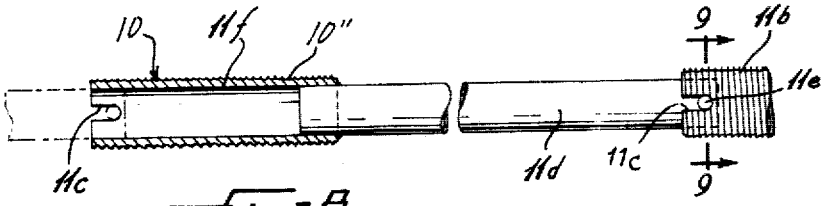
FIG. 8 shows one driven modular section of the winch drum, partly in elevation and partly in longitudinal section and shown connected to an adjacent end of the driving modular section.
Figure 9:
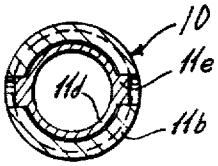
FIG. 9 is a cross-section taken along line 9—9 of FIG. 8.

As shown in FIGS. 7 to 9, the battens system is made of modular sections, so as to be extended in accordance with the desired length of the winch drum and each section connected to the other by means of a universal joint for ease of installation on roof joists 24, which often are not exactly at the same level. The driving section 10', which carries the hydraulic motor 34, comprises a tube 11 at both ends of which are welded grooved sleeves 11*a* and 11*b* of such a length that the sleeves 11*a* and 11*b* are respectively directly mounted above a support joist 24 and with the respective grooved sleeve extending through aperture 21 of support plate 20 and its groove 18 engaged by the sets of ribbed rollers 28, as previously described. Each grooved sleeve carries a cable 12 wound thereon as noted above. Thus, the driving section 10' is supported near both ends by the two joists 24. The left-hand grooved sleeve 11*b*, that is the sleeve opposite the end carrying the motor 34, has a pair of diametrically opposed notches 11*c*.

All driven modular sections 10'' are of similar construction and each includes a tube lid having diametrically opposed radially protruding studs 11*e* at one end for removably engaging the notches 11*c* of the driving section or of another driven section. The driven section further includes a grooved sleeve 11*f* at its other end provided with notches 11*c* for receiving the studs of an adjacent driven section. Therefore, each driven section has one grooved sleeve supported over joist 24 by sets of ribbed rollers 28 engaging the helical groove 18 of the section of the sleeve.

The notch and stud engagement permits rotation of the driven sections by the driving section, while forming universal joints which are simple in construction and allow for mounting of any desired length of winch drum over roof joists 24 which might be at an uneven level. Each driven section and the driving section are positively moved axially of the winch drum an exact distance as determined by the similar pitch of the helical grooves 18 of the various sections.

It is noted that the cables depend from the grooved sleeves adjacent the associated support joists 24, so that the joists are submitted only to vertical loading and not to torsion or to horizontal stress.

Figure 1:
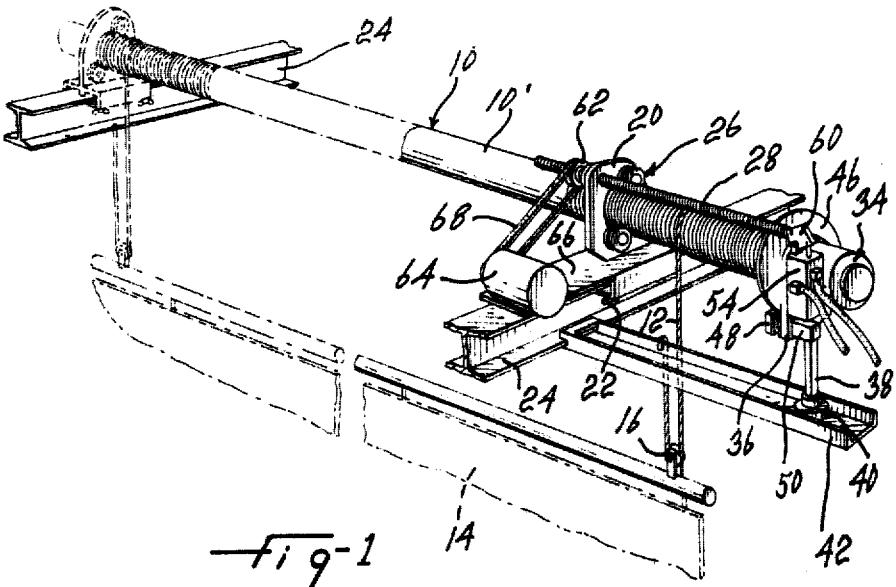
FIG. 1 is a perspective view of part of the battens system in accordance wih the invention.
Figure 2:
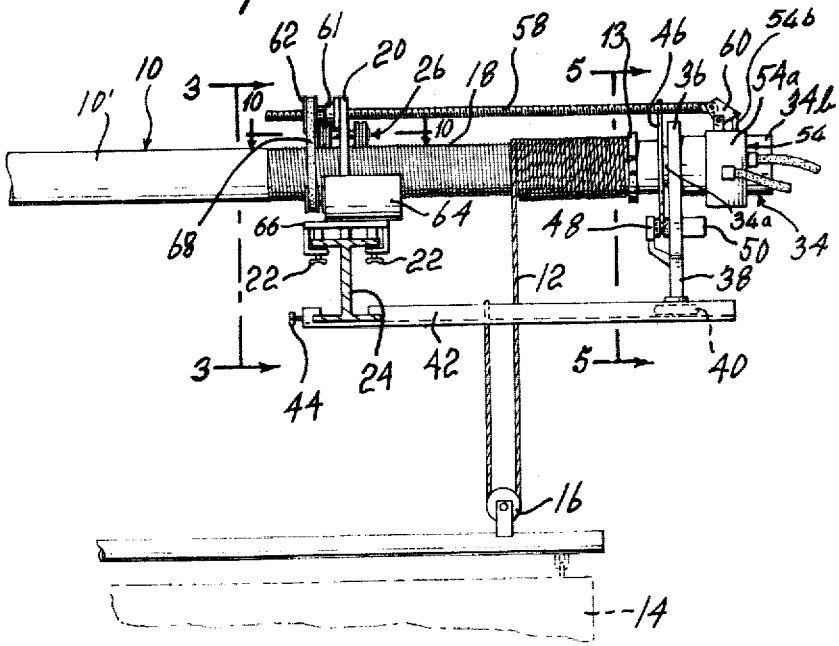
FIG. 2 is a side view of the battens system of FIG. 1.
Figure 3:
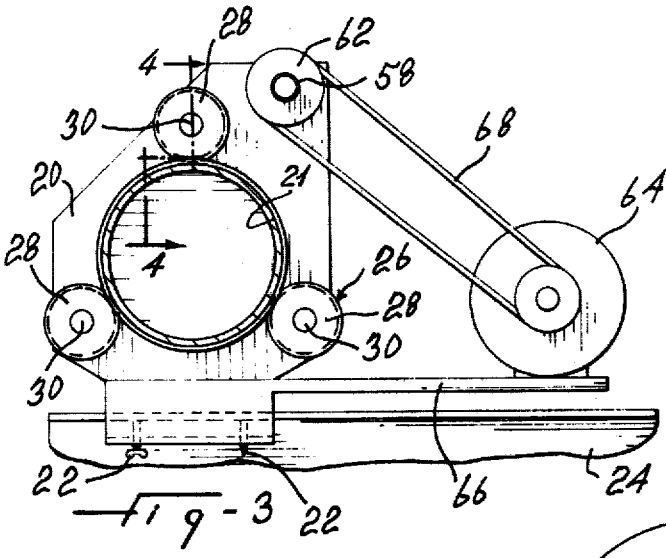
FIG. 3 is a cross-section taken along line 3—3 of FIG. 2.
Figure 6:
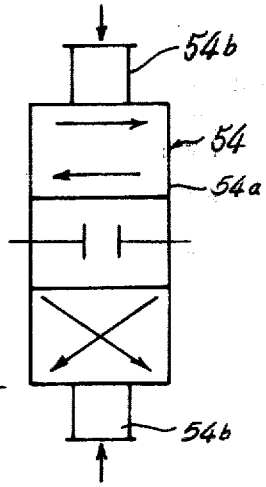
FIG. 6 is a schematic view of the hydraulic circuit of the spool valve illustrated in FIG. 2.

The raising and lowering of the scenery is controlled by a positioning mechanism arranged as a slave system. A first embodiment of the positioning mechanism is shown in FIG. 2 and a second embodiment is shown in FIG. 11. Referring to FIG. 2, a spool valve 54 has its body 54*a* directly secured to the motor housing 34*b* and is in direct communication with the ports of the motor. The spool valve 54 has a spool 54*b* which is vertically slidable, as shown in FIGS. 2 and 6, to take three positions, namely: a neutral center position to which the two ports of the motor 34 are blocked; a lower position in which the motor rotates in one direction; and an upper position in which the motor rotates in the opposite direction for raising and lowering the scenery 14, respectively. The valve 54 itself is of conventional construction, but it must be stationarily mounted with respect to the motor 34, so as to move along with the winch drum and the motor in the axial movement. A controlling member 60, in the form of a rocker arm pivoted on the valve body 54*a* and to the end of the spool 54*b*, is pivotally connected to a threaded rod 58, which extends parallel to winch drum 10. A journal 61 for a pulley 62 is secured to support plate 20; pulley 62 is rotatably mounted on journal 61 and is in threaded engagement with the threaded rod 58 which extends freely through journal 61. An electric reversible motor 64 is mounted on a plate 66 (see FIG. 3) secured to the support plate 20, and has its shaft coupled to pulley 62 by means of a belt 68. The hydraulic motor 34 being stopped, that is with the spool valve 54 in neutral central position, raising or lowering of the scenery is accomplished by starting electric motor 64 in the desired one of two directions, therefore rotating pulley 62 which causes axial movement of the threaded rod 58 in a direction corresponding to the winding or unwinding of the cable. The rod 58 causes pivoting of rocking arm 60 and displacement of the spool 54*b*, so that the spool valve admits fluid under pressure to the hydraulic motor in the desired direction to cause rotatin of the winch drum and, consequently, its axial movement in the same direction as the movement of the threaded rod 58.

Since valve body 54*a* starts to move as soon as fluid is fed to motor 34, there is obtained very progressive movement of the rocking arm 60 and, consequently, movement of the spool 54*b* which produces very progressive opening of the ports in the spool valve to permit progressive smooth acceleration of the motor 34. As soon as electric motor 64 is stopped, the rod 58 stops and the continuing rotation and consequent axial displacement of the winch drum and of the valve 54 causes rocking of the rocking arm 60 and displacement of the spool 54 to its neutral position. Here again, a smooth deceleration to a stopping position is obtained. As the winch drum moves axially at the same speed as the threaded rod 58, there is no pivotal movement of the rocking arm 60 and the spool of the valve remains in its stationary position. For manual positioning of the scenery, electric motor 64 is reversible, constant or variable speed motor, remote-controlled by a manual switch operated to raise and lower the scenery to the desired position. For automatic positioning of the scenery, motor 64 is a reversible stepping motor which can be programmed from a remote location to rotate its shaft a predetermined number of turns in either direction at a variable or at a constant speed and then stops.

Figure 12:
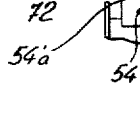
FIG. 12 is an enlarged side view of part of the slave mechanism of FIG. 11.
Figure 13:
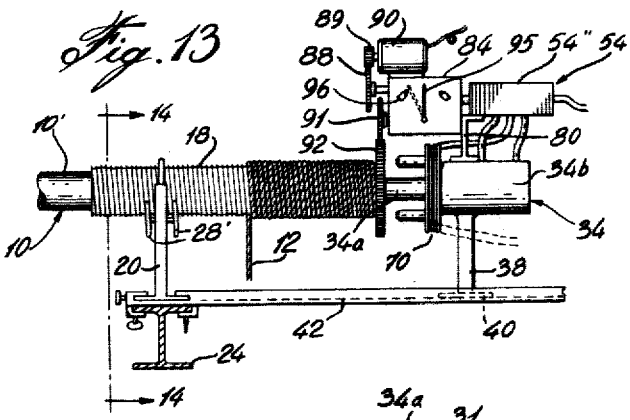
FIG. 13 is a partial side view of a modified battens sytem, also showing another embodiment of the slave mechanism.

FIGS. 11 and 12 show another embodiment of the positioning mechanism. Again, the three-way spool valve 54' is directly mounted on the motor housing 34*b* and has its ports in direct communication with the two ports of the motor housing. The spool 54'*b* is slidable horizontally of the valve body 54'*a* between a central neutral position and two limit positions coresponding to the winding and unwinding rotation of the winch drum, respectively. The spool 54'*b* is tubular and is connected to a flexible liquid feeding tubing 68', which also serves to operate a brake system 70 in a manner described in the above-noted co-pending patent application entitled: "BRAKE". The other end of tubular spool 54'*b* is connected to liquid return tubing 72. A nut 74 is secured to the tubular spool 54'*b* and a threaded rod 76 is threaded in nut 74 and extends parallel to the winch drum 10 and constitutes the output shaft of an electric motor 78, which is directly mounted on the support plate 20 of the driving section 10'. Motor 78 is a reversible motor which, as in the other embodiment, can have constant or a variable speed and can be a manually-controlled or a stepping motor for automatic positioning of the scenery. The rod 76 just rotates and will move nut 74 in one direction or in the other, controlling the operation of the spool valve 54' accordingly to cause rotation of the winch drum by the motor 34 in the desired direction. Obviously, in both embodiments, the arrangement of the ports and of the spool valve and the pitch of the threaded rod 58, or 76, must be selected so that the controlling member will move in the appropriate direction corresponding to the axial movement of the winch drum corresponding to the winding or unwinding of the scenery, respectively. The rocking arm 60 of the first embodiment, or the nut 74 of the second embodiment, constitutes a controlling member which is connected to the spool of the valve and which is power driven to move linearly parallel to the linear movement of the winch drum. When the winch drum moves axially at the speed of the controlling member, the spool remains stationary relative to the valve body. When there is a differential in the speed, the spool changes its position relative to the valve body. By properly shaping the ports in the valve body and in the spool, if the latter is tubular, as in the second embodiment, a very exact positioning of the scenery can be obtained, as well as very smooth acceleration and deceleration of the same.

When the motor 34 is energized to rotate the winch drum in a direction such as to raise the scenery, the peripheral ribs 32 of the bearing rollers 28 engage the groove 18 in the winch drum, so that the drum is moved to the right at each turn by a distance equal to the pitch of the cable, thus preventing the scenery being shifted to right or left. The reverse will happen during lowering of the scenery, and again the scenery will not shift laterally. The pressure and flow rate of the hydraulic fluid fed to hydraulic motor 34 are selected so as to apply adequate torque to the winch drum to raise the scenery or similar load of maximum intended weight at a maximum intended speed corresponding to the full opening of the valve ports. The valve automatically partially closes, depending on a lesser load and desired vertical speed. In case of overload, such as when the positioning mechanism fails and the motor continues to rotate when the scenery has reached its upper position, strain gauge 52 will operate to de-energize the motor 64 or 78. Upon reversal of the motor to lower the scenery, the required torque will be that needed to keep at the desired speed the lowering of scenery of a given weight. Again, valve 54 or 54' automatically adjusts the flow rate of fluid fed to motor 34. When the scenery hits the floor or an obstacle, strain gauge 52 will again operate to stop controlling motor 64 or 78 with practically immediate stopping of hydraulic motor 34.

Figure 14:
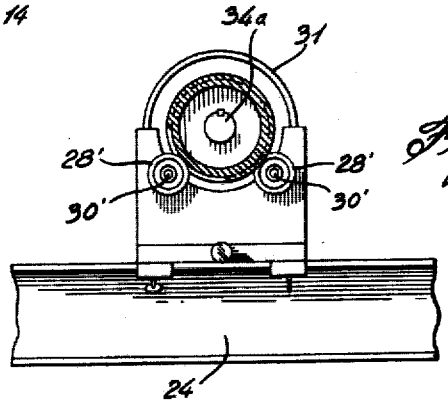
FIG. 14 is a cross-section taken along line 14—14 of FIG. 13.

Referring to FIGS. 13 to 18, there is shown a modified battens system and including a modified slave mechanism for controlling the operation of the battens system. As in the other embodiments, the driving section 10' of the winch drum 10 is supported at two spaced zones by supports and bearing assemblies secured to the roof joist 24. Each support plate 20 carries a set of rollers 28', which are characterized by the fact that they are mounted on shafts 30' which are arranged parallel to the longitudinal axis of the winch drum while the rollers 28' are made of flexible material, such as plastic material, so as to flex and be deformable in such a way that their peripheral portion will engage the helical groove 18 of the winch drum sections, despite the fact that this groove is inclined to the long axis of the shaft. Preferably, there are only two sets of rollers 28' engaging the helical groove 18 at 120° apart underneath the winch drum while the support plate 20 is provided with a curved guard wire 31 spacedly surrounding the top portion of the winch drum, as shown in FIG. 14. The driving section 10', as in the other embodiments, is driven in rotation by a reversible hydraulic winch drum driving motor 34, the output shaft **34*a* of which is directly secured to the outer end of the driving section 10' and the motor housing 34*b* of which is prevented from rotation by means of the radial arm 38 and guide follower 40 engaging the channel shaped guide 42 secured to the support plate 20 and extending parallel to the long axis of the winch drum 10. Therefore, the motor housing 39*b* moves along with the winch drum 10 in its longitudinal movement. A hydraulic spool valve 54 controls the operation of the hydraulic motor 34. This spool valve has a valve body 54'', which is secured to the motor housing 34*b* by means of a bracket 80 and is oriented in such a way that the spool 81 of the spool valve is arranged parallel to the long axis of the winch drum, as in the other embodiment of FIG. 11. The spool 81 has a central position wherein it stops rotation of the motor 34, one limit position in which it drives the motor 34 in one direction and an opposite limit position in which it drives motor 34** in the opposite direction.

Figure 17:
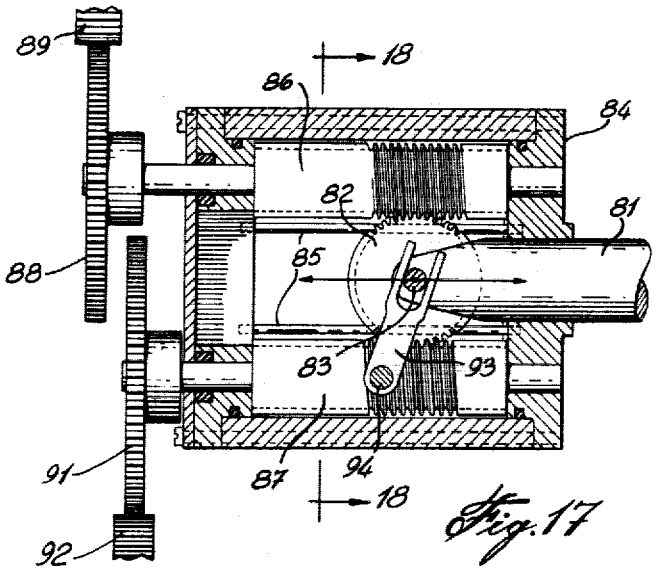
FIG. 17 is a longitudinal section of part of the mechanism shown in FIG. 15.

The spool 81 is provided at its outer forked end, as shown in FIG. 17, with a gear wheel 82, which is mounted for free rotation about a shaft 83 carried by the spool 81 and extending transversely of the same. The spool 81 extends and is longitudinally guided within a housing 84, secured to bracket 80. Spool 81 and gear 82 are thus longitudinally movable within the housing 84 and rotation of the spool 81, together with gear 82, is prevented by guide rods 85, which extend on each side of the gear 82 above and below the spool and are fixed to the end walls of the housing 84.

First and second worms 86 and 87, respectively, are rotatably mounted within the housing 84 and extend parallel to the axis of the spool 81 above and below the same, so as to mesh with diametrically opposed portions of the gear 82.

The shaft of the first worm 86 is fitted with a driving gear 88 meshing with a pinion 89 secured to the output shaft of a reversible electric stepping motor 90 mounted on the housing 84. This electric stepping motor 90 is the controlling motor. The second worm 87 is similarly fitted with a gear 91 meshing with a second gear 92 coaxial with and secured to the outer end of the driving section 10' of the winch drum.

Figure 15:
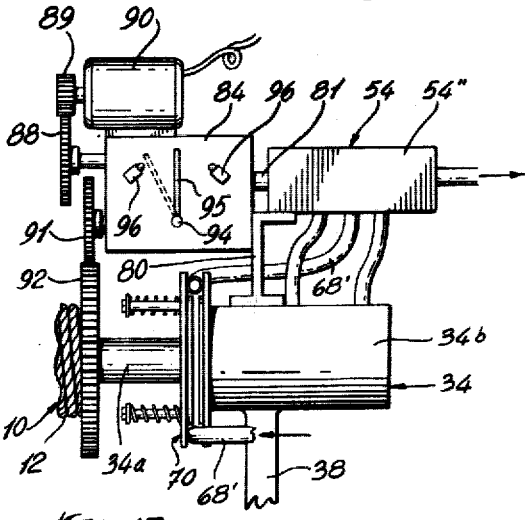
FIG. 15 is an enlarged side elevation of the slave mechanism of FIG. 13.
Figure 16:
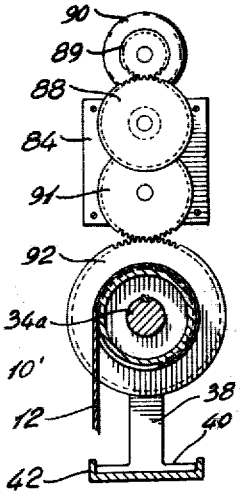
FIG. 16 is an end view of the slave mechanism of FIG. 15 and showing the winch drum in section.
Figure 18:
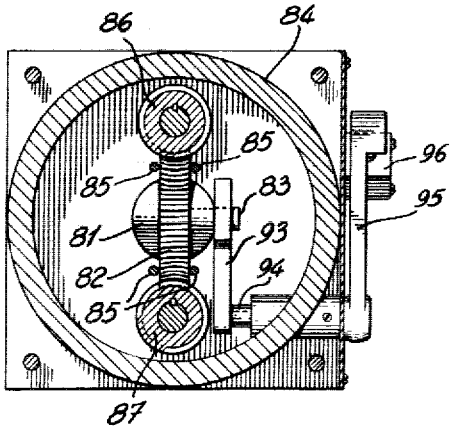
FIG. 18 is a cross-section taken along line 18—18 of FIG. 17.

The slave mechanism further includes an indicating and monitoring system to automatically stop operation of the winch drum driving motor whenever there is failure in the system. To this end, a forked lever 93 engages shaft 83 of gear 82 and is pivoted in the housing 84 by means of a shaft 94. An indicating arm 95 is fixed to the shaft 94 on the outside of housing 84, as shown in FIGS. 15 and 18. This arm 95, when pivoted to one or the other extreme limit positions, will hit on one or the other limit switch 96 secured to the housing. These switches are connected to an electric circuit to automatically stop the supply of hydraulic fluid to the driving motor 84 in accordance with the spool having moved past one or the other of its normal limit positions.

As in the embodiment of FIG. 11, there is provided a braking system 70 responsive to the flexibility of the hydraulic fluid feeding hose or tubing 68' to positively brake the winch drum against rotation whenever there is an absence of hydraulic fluid pressure within the hose 68'.

The system of this embodiment operates as follows:

It has the advantage of sensing the much faster speed of rotation of the winch drum instead of sensing its longitudinal movement. Therefore, it is more accurate than the previous embodiments in the exact positioning of the scenery or other load.

Supposing the winch drum is stopped with the spool 81 in its central position, starting of the controlling electric stepping motor 90 will cause rotation of the first worm 86 in one or the other direction and, therefore, rotating the gear 82 which reacts against the stationary second worm 87 to thereby cause movement of the spool to one of its limit positions to open the valve and feed the hydraulic fluid to the hydraulic motor 34. As soon as the winch driving motor starts, rotation of the winch drum causes the rotation of the second worm in the same direction, thereby slowing down the longitudinal movement of the spool; when the two worms rotate at the same speed, the shaft 83 of gear 80 remains stationary while gear 80 simply rotates. Therefore, stepping motor 90 drives the winch drum at exactly the required speed. Upon stopping of the controlling electric motor 90, the reverse operation takes place and the spool is gradually brought back to its central position, resulting in smooth deceleration of the rotation of the winch drum and its stopping at the exact desired position.

This system is fail-safe because, if the controlling worm 86 grips, the spool will automatically move to its central position, thereby stopping the hydraulic motor. If the second worm 87, which is controlled by the winch drum, stops to rotate for whatever reasons, such as an obstruction on the load or gripping of the second worm, then the spool 81 will reach one or the other of its extreme limit positions, causing actuation of one or the other limit switches 95 and thereby stopping of the hydraulic driving motor.

Finally, the system is fail-safe because the output, which is the spool, cannot drive the inputs represented by the worms, since the gear 82 cannot drive these worms in rotation.

The above arrangement thus provides a positive stop of the scenery or similar load, which is safe to the people on the stage. The above-disclosed battens system is a great improvement over the known system, as it takes up much less space on the stage, since no pulleys and counterweights are required. With the prior art system, a full wall of the stage was often taken as some stages had up to fifty battens. With the present invention, the battens are positioned above the stage, one beside the other, to operate as many sceneries as needed. The only equipment on stage is a control desk. Also, since joists or beams 24 are subjected to vertical loading only, they will not normally require reinforcement for installation of the battens system. Each winch drum could obviously operate plural sceneries in synchronism located at predetermined distance apart by providing additional cables wound on the same winch drum and passing such cables through a system of pulleys secured to the ceiling of the stage.

What we claim is:

1. A battens system comprising:

(a) a support;

(b) an elongated winch drum upon which at least one cable supporting a scenery or similar load is wound, said winch drum being generally horizontally disposed;

(c) bearing means assembly secured to said support for rotatably mounting said winch drum and including means for longitudinally moving said winch drum at each turn by a distance equal to the pitch of the cable wound on, or unwound from, the winch drum;

(d) a reversible winch drum driving motor for rotating said winch drum in anyone of the two directions; and (e) means to control the operation of said winch drum driving motor including a control mechanism having a body and an operating member mounted in said body and movable between three positions, namely: one limit position causing the motor to rotate in one direction; a central position causing the motor to stop; and another limit position causing said motor to rotate in the other direction, movement of said operating member relative to said body from said central position to one of the other of said limit positions, and vice versa, causing acceleration and deceleration of said winch drum driving motor, a controlling reversible motor having an output shaft, a control member responsive to and movable at a speed proportional to the speed of said output shaft and means responsive to the difference of movements of said control member and of said winch drum to move said operating member between its three positions relative to said body.

2. A battens system as defined in claim 1, wherein said control member is movable by said controlling reversible motor in a path parallel to the longitudinal movement of said winch drum, said body being supported for movement at the speed of, and in the same direction as, the longitudinal movement of said winch drum and means connecting said control member to said operating member.

3. A battens system as defined in claim 1, wherein said control member is rotatable at a speed proportional to the speed of said output shaft and constitutes a first rotary means, and further including a second rotary means responsive to, and rotatable at, a speed proportional to the speed of rotation of said winch drum and said means responsive to the difference of movements of said control member and of said winch drum being means responsive to the difference of rotational movements of said first and second rotary means.

4. A battens system as defined in claim 1, wherein said winch drum driving motor is a reversible hydraulic motor having an output shaft connected to one end of said winch drum and having a motor housing longitudinally movable with said winch drum, means to prevent rotation of said motor housing as said motor rotates said winch drum in anyone of two directions, said control mechanism being a hydraulic spool valve, said body being the valve body and said operating member being the spool of the valve, said body fixedly supported with respect to said motor housing, said control member driven by said controlling reversible motor in a path substantially parallel to the longitudinal movement of said winch drum and said means responsive to the difference of movements of said control member and of said winch drum being responsive to the longitudinal movement of said control member parallel to said winch drum and to the longitudinal movement of said winch drum.

5. A battens system as defined in claim 4, wherein said controlling reversible motor is fixedly mointed on said support and its output shaft drives an endless screw arranged parallel to the long axis of said winch drum, said control member being a nut threaded on said screw, said spool being arranged parallel to the long axis of said winch drum and said nut secured to said spool.

6. A battens system as claimed in claim 4, wherein said control member is an endless screw mounted parallel to the long axis of said winch drum and mounted for longitudinal movement, an inwardly threaded pulley screwed on said endless screw and driven in rotation at a stationary position by said controlling reversible motor, and further including means for transmitting the longitudinal movement of said endless screw to the spool of said valve.

7. A battens system as defined in claim 1, wherein said winch drum driving motor is a reversible hydraulic motor having a flexible supply hose for hydraulic fluid under pressure, said hose collapsible when no pressure exists therein, and further including a brake means responsive to the hydraulic pressure within said hose and connected to said winch drum and releasable when there is hydraulic pressure within said hose and effective to stop rotation of said winch drum when there is an abscene of hydraulic pressure within said hose.

8. A battens system as defined in claim 1, wherein said winch drum comprises a driving section and at least one driven section joined in end-to-end relationship to the driving section by a universal joint, there being provided a cable for each section wound on a respective section for supporting a scenery or other load, the outer surface of each winch drum section being provided with a helical groove in which the wound portion of the cable is inserted, said driving motor being connected to said driving section to rotate said winch drum in either one of the two directions, said bearing means including two bearing assemblies spaced along said driving section for rotatably supporting said driving section at spaced zones along the length thereof and one bearing assembly for each driven section rotatably supporting said driven section at its end remote from its end fitted with said universal joint, each bearing assembly including a support and rollers carried by said support and engaging said grooves of the winch drum section at spaced points around the same and rotatably supporting said section, said rollers causing, upon rotation of said winch drum by said motor, longitudinal movement of said winch drum.

9. A battens system as defined in claim 8 wherein said driving motor has a motor housing and a driving shaft, said driving shaft secured to an end of said winch drum to rotate said winch drum in either one of two directions, and further including a fixedly-supported quide means extending parallel to said winch drum and an arm secured to said motor housing, engaging and guided by said guide means in either one of two directions, while allowing its longitudinal movement together with said winch drum.

10. A battens system as claimed in claim 8, wherein said rollers are made of flexible and deformable material and are mounted for free rotation on axles arranged parallel to the longitudinal axis of the associated winch drum section, said rollers flexing as they rotate to engage said helical grooves.

11. A batttens system as claimed in claim 8, wherein one end of said cable is attached to the winch drum section at a point remote from an associated bearing assembly and is wound on the winch drum section in the direction of said bearing assembly to issue from said winch drum at a point close to said bearing assembly.

12. A battens system as defined in claim 11, further including a collar rotatable around said winch drum section, said one end of said cable secured to said collar and means to adjustably secure said collar on said winch drum section to adjust the length of said cable wound on said winch drum section.

13. A battens system comprising:

(a) a pair of spaced supports;

(b) an elongated winch drum upon which at least two cables supporting a scenery or similar load is wound, said winch drum being generally horizontally disposed;

(c) a bearing assembly secured to each support for rotatably mounting said winch drum at two spaced zones longitudinally thereof, and including means for longitudinally moving said winch drum as the same is rotated at each turn by a distance equal to the pitch of the cables wound on, or unwound from, said winch drum;

(d) a winch drum driving, reversible, hydraulic motor for rotating said winch drum in anyone of two directions, said motor having a motor housing and an output shaft, said output shaft directly connected to one end of said winch drum;

(e) means to prevent rotation of said motor housing while allowing displacement of said motor housing along with said winch drum in its longitudinal movement; and (f) means to control the operation of said winch drum driving motor including a hydraulic spool valve, hydraulically connected to said motor and having a valve body fixedly mounted relative to said winch drum driving motor housing and a spool mounted in said valve body and movable relative to said valve body between three positions, namely: one limit position causing the hydraulic motor to rotate in one direction; a central position causing the hydraulic motor to stop; and another limit position causing said motor to rotate in the other direction, movement of said spool relative to said valve body from said central position to one or the other of said limit positions, and vice versa, causing progressive acceleration and deceleration of said winch drum driving motor, a gear wheel mounted for free rotation at the outer end of said spool, two spaced parallel worms meshing with diametrically-opposite portions of said gear wheel and supported for rotation about their longitudinal axis fixedly with respect to said valve body, a controlling reversible motor driving one of said worms and transmission means causing rotation of the other worm by the rotation of said winch drum, whereby the difference in the rotational speeds of said two worms will cause movement of said spool longitudinally of said valve body.

14. A battens system as defined in claim 13, wherein said valve body and said spool are arranged such that said spool is movable in a path parallel to the longitudinal movement of said winch drum, said worms being mounted for rotation about longitudinal axes parallel to the long axis of said winch drum and are mounted in a housing fixedly secured with respect to said motor housing, said controlling reversible motor being also fixedly secured with respect to said motor housing, gearing connecting said first worm to the output shaft of said controlling motor and said transmission means including gearing on said winch drum and on said second worm.

15. A battens system as claimed in claim 4 or 13, wherein said means to prevent rotation of said motor housing include a radial arm fixedly secured to said motor housing, a fixedly supported channel extending parallel to the long axis of said winch drum, said radial arm engaging said channel to prevent rotation of said motor housing, said arm longitudinally displaceable within and guided by said channel.

16. A battens system as claimed in claim 9, wherein said guide means is a channel rigidly secured to said support extending underneath said driving section and said arm engages within said channel.

* * * * *